US008672319B2

(12) United States Patent
Inoue

(10) Patent No.: US 8,672,319 B2
(45) Date of Patent: Mar. 18, 2014

(54) SHEET FEEDERS AND IMAGE FORMING APPARATUSES HAVING THE SAME

(75) Inventor: Masafumi Inoue, Gifu (JP)

(73) Assignee: Brother Kogyo Kabushiki Kaisha, Nagoya-shi, Aichi-ken (JP)

( * ) Notice: Subject to any disclaimer, the term of this patent is extended or adjusted under 35 U.S.C. 154(b) by 0 days.

(21) Appl. No.: 13/600,391

(22) Filed: Aug. 31, 2012

(65) Prior Publication Data

US 2013/0082439 A1 Apr. 4, 2013

(30) Foreign Application Priority Data

Sep. 30, 2011 (JP) ..... 2011-216226

(51) Int. Cl.
*B65H 5/00* (2006.01)

(52) U.S. Cl.
USPC ..... 271/225

(58) Field of Classification Search
USPC ..... 271/225, 9.02; 399/401
See application file for complete search history.

(56) References Cited

U.S. PATENT DOCUMENTS 5,615,405 A 3/1997 Yamaguchi
7,515,866 B2 * 4/2009 Togashi et al. ..... 399/381

FOREIGN PATENT DOCUMENTS

JP 59-061147 A 4/1984
JP 59-173651 A 11/1984
JP 03-133865 A 6/1991
JP 03133865 A * 6/1991
JP 08-114959 A 5/1996

* cited by examiner

*Primary Examiner* — Jeremy R Severson
(74) *Attorney, Agent, or Firm* — Banner & Witcoff, Ltd.

(57) ABSTRACT

A sheet feeder is provided that includes a feeding unit configured to feed a sheet through a feeding path and a guide portion that is bent in a shape of a relaxation curve and configured to feed the sheet thereon and turn a feeding direction of the sheet.

17 Claims, 3 Drawing Sheets

SHEET FEEDERS AND IMAGE FORMING APPARATUSES HAVING THE SAME

CROSS-REFERENCE TO RELATED APPLICATION

This application claims priority under 35 U.S.C. §119 from Japanese Patent Application No. 2011-216226 filed on Sep. 30, 2011. The entire subject matter of the application is incorporated herein by reference.

BACKGROUND

1. Technical Field

The following description relates to one or more sheet feeders and image forming apparatuses provided therewith.

2. Related Art

A sheet feeder has been known that includes a guide portion for turning around a fed sheet, the guide portion being curved in an arc shape having a constant radius of curvature.

SUMMARY

A frictional force caused by contact between the guide portion and the sheet is generally proportional to a normal force applied to a contact surface therebetween. Further, the normal force is generally proportional to an acceleration applied to the sheet in a direction perpendicular to the sheet.

The acceleration is generally inversely proportional to the curvature radius of a feeding path. Therefore, if a sheet having been fed on a linear feeding path (hereinafter referred to as a "linear section") is turned around, the following problem might be caused.

The curvature radius of the linear section is an infinite or extremely large value, while the curvature radius of a turn-around section where the sheet is turned around is a finite value smaller than the curvature radius of the linear section.

Hence, when the sheet is transferred from the linear section onto the turn-around section, a great acceleration is applied to the sheet, and it results in an increased normal force and a great frictional force acting on the sheet. Namely, around a boundary area where the feeding direction of the sheet is turned around, i.e., around a boundary between the linear section and the turn-around section, a great frictional force is applied to the sheet. It might lead to a sheet jam caused around the boundary area.

Aspects of the disclosure are advantageous to provide one or more improved techniques, for sheet feeders and image forming apparatuses having the same, which techniques make it possible to prevent the aforementioned sheet jam.

According to aspects of the disclosure, a sheet feeder is provided, which includes a feeding unit configured to feed a sheet through a feeding path, and a guide portion that is bent in a shape of a relaxation curve and configured to feed the sheet thereon and turn a feeding direction of the sheet.

According to aspects of the disclosure, further provided is an image forming apparatus including an image forming unit configured to form an image on a sheet, and a sheet feeder configured to re-feed, to the image forming unit, the sheet with the image formed thereon, the sheet feeder including a feeding unit configured to feed the sheet through a feeding path, and a guide portion that is bent in a shape of a relaxation curve and configured to feed the sheet thereon and turn a feeding direction of the sheet.

BRIEF DESCRIPTION OF THE ACCOMPANYING DRAWINGS

DETAILED DESCRIPTION

It is noted that various connections are set forth between elements in the following description. It is noted that these connections in general and, unless specified otherwise, may be direct or indirect and that this specification is not intended to be limiting in this respect.

Hereinafter, an embodiment according to aspects of the disclosure will be described with reference to the accompanying drawings.

1. Configuration of Image Forming Apparatus

Figure 1:
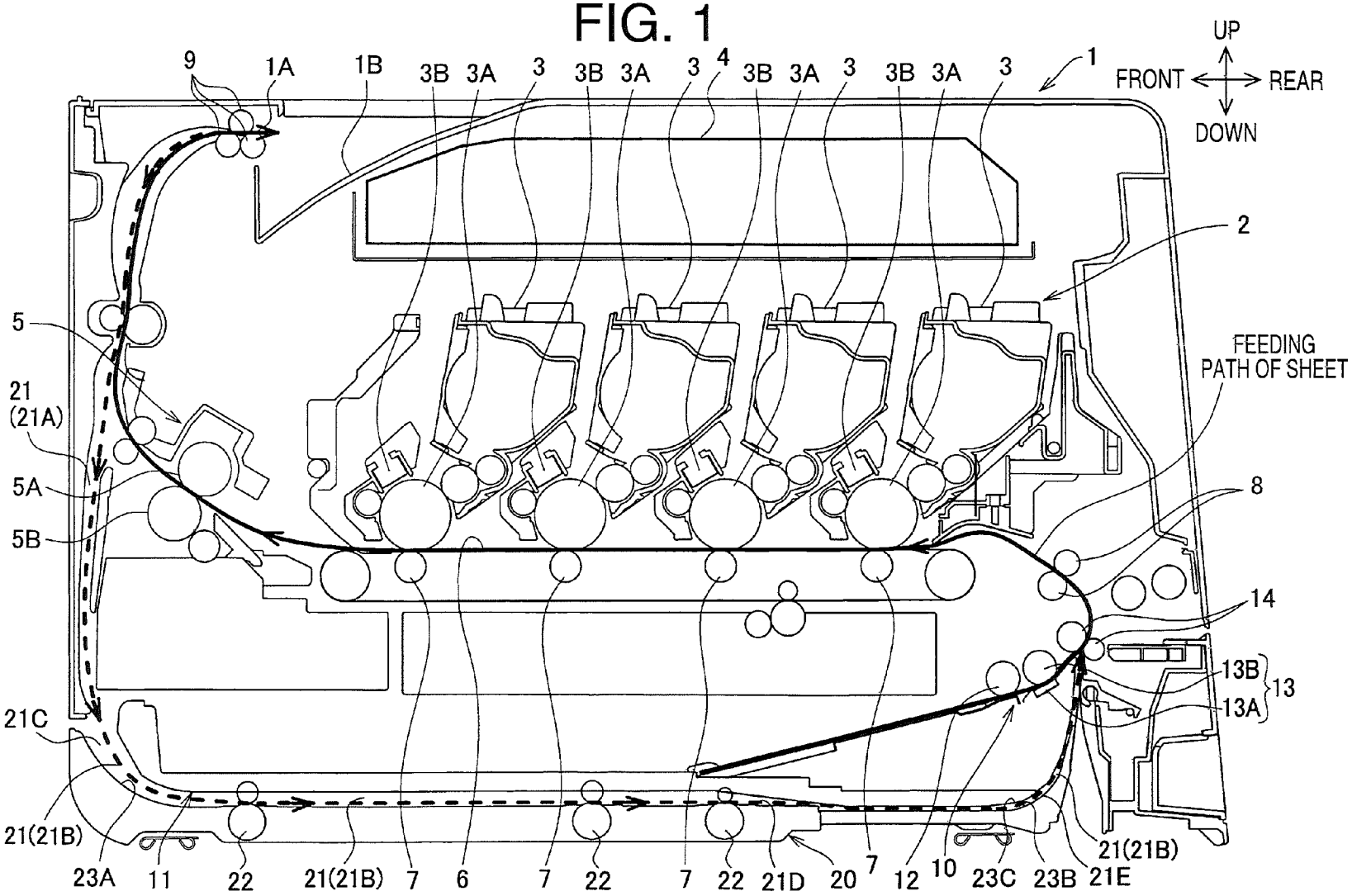
FIG. 1 is a cross-sectional side view showing an internal configuration of an image forming apparatus in an embodiment according to one or more aspects of the disclosure.

As shown in FIG. 1, an image forming apparatus 1 includes an image forming unit 2, a sheet feeding unit 10, and a re-feeding unit 20. The image forming unit 2, the sheet feeding unit 10, and the re-feeding unit 20 are attached to a main body of the image forming apparatus 1. The main body is a portion (e.g., including a housing and frames) that is not separated or detached from the image forming apparatus 1 in normal use.

The image forming unit 2 is configured to form an image on a sheet. The sheet feeding unit 10 is configured to pick up a sheet from one or more sheets placed on a feed tray 11 and feed the picked-up sheet to the image forming unit 2.

The re-feeding unit 20 is a member forming at least a part of a re-feeding path 21. The re-feeding path 21 is a feeding path for re-feeding the sheet ejected from the image forming unit 2 toward an inlet side of the image forming unit 2. In the embodiment, the re-feeding unit 20 is detachably attached to the main body at a lower side than the feed tray 11.

The image forming unit 2 is an electrophotographic printing unit that includes one or more process cartridges 3, one or more exposure units 4, and a fuser 5. It is noted that, in the embodiment, the image forming unit 2 is a color printing unit provided with a plurality of respective process cartridges 3 corresponding to a plurality of colors such as black, yellow, magenta, and cyan.

Each process cartridge 3 accommodates a photoconductive drum 3A configured to carry a developer image thereon, and an electrification device 3B configured to charge the photoconductive drum 3A. When the charged photoconductive drum 3A is exposed by the exposure unit 4, an electrostatic latent image is formed on an outer circumferential surface of the photoconductive drum 3A. After that, when charged development agent is supplied onto the photoconductive drum 3A, the developer image is carried on the outer circumferential surface of the photoconductive drum 3A.

The image forming apparatus 1 further includes a transfer belt 6 configured to feed the sheet fed from the feed tray 11 to the photoconductive drums 3A. There are transfer rollers 7 each of which is disposed in such a position as to face the corresponding photoconductive drum 3A across the transfer belt 6. Each transfer roller 7 is configured to transfer, onto the sheet, the developer image carried on the photoconductive drum 3A.

The sheet, fed from the feed tray 11 to the image forming unit 2 by the sheet feeding unit 10, is conveyed to two registration rollers 8. The registration rollers 8 are configured to make a skew correction for the sheet and then introduce the sheet into the image forming unit 2 at a predetermined moment.

The fuser 5 includes a heating roller 5A configured to contact and heat the sheet, and a pressing roller 5B configured to press the sheet against the heating roller 5A. The fuser 5 is configured to heat, by the heating roller 5A, the sheet with the developer image transferred thereon so as to fix, onto the sheet, the developer (the developer image) transferred onto the sheet.

On the main body of the image forming apparatus 1, a catch tray 1B is formed that is configured such that the sheet ejected from an outlet port 1A is placed thereon. At the outlet port 1A, a plurality of ejection rollers 9 are disposed that are configured to rotate in contact with the sheet ejected from the fuser 5 and provide a feeding force to the sheet.

In single-side printing to form an image only on a first side of the sheet, the ejection rollers 9 eject, onto the catch tray 1B, the sheet ejected from the fuser 5. Meanwhile, in double-side printing to form images on both sides (the first and second sides) of the sheet, the ejection rollers 9 reverse the feeding direction of the sheet fed from the fuser 5 to the outlet port 1A and re-feed the sheet toward the re-feeding unit 20.

The re-feeding unit 20 guides the sheet fed onto the re-feeding path 21, onto a section, of the feeding path extending from the sheet feeding unit 10 to the image forming unit 2, which section is upstream relative to the registration rollers 8 and downstream relative to the separation mechanism 13 in the feeding direction.

In the embodiment, there are two feed rollers 14 disposed on a section of the feeding path between the separation mechanism 13 and the registration rollers 8. The sheet, fed onto the re-feeding path 21, is guided to an entrance of the feed rollers 14.

Further, the sheet feeding unit 10 includes a pickup roller 12 and a separation mechanism 13. The pickup roller 12 is configured to contact a top one of one or more sheets stacked on the feed tray 11 and feed one or more sheets including the top sheet toward the image forming unit 2. The separation mechanism 13 includes a separation pad 13A and a separation roller 13B. The separation mechanism 13 is configured to separate and feed the sheets fed by the pickup roller 12 to the image forming unit 2 on a sheet-by-sheet basis.

2. Re-Feeding Path

The re-feeding path 21 includes a first re-feeding path 21A that substantially vertically extends from the ejection rollers 9 down to the re-feeding unit 20, and a second re-feeding path 21B that forms a part of the re-feeding unit 20. The second re-feeding path 21B includes a first curving section 21C, a second curving section 21E, and a linear section 21D that connects the first curving section 21C with the second curving section 21E.

The first curving section 21C is configured to turn the feeding direction of the sheet fed from the first re-feeding path 21A onto the re-feeding unit 20, in the horizontal direction by an angle of substantially 90 degrees. The linear section 21D is configured to linearly extend from the first curving section 21C to the second curving section 21E substantially in the horizontal direction. The second curving section 21E is configured to turn the feeding direction of the sheet fed on the linear section 21D, in an upward direction by an angle of substantially 90 degrees.

Further, on the linear section 21D of the re-feeding unit 20, there are provided a plurality of re-feeding rollers 22 for feeding the sheet. The re-feeding rollers 22 are configured such that at least one of them contacts the sheet and provides a feeding force to the sheet.

The circumferential velocity of the re-feeding rollers 22 for providing the feeding force is higher than the circumferential velocity of the transfer belt 6. Therefore, at least the feeding velocity of the sheet fed on the second re-feeding path 21B is higher than the feeding velocity of the sheet fed on the transfer belt 6. It is noted that a feeding section on the transfer belt 6 will be referred to as a first section. Further, the second re-feeding path 21B will be referred to as a second section.

The first curving section 21C includes a first guide portion 23A configured to contact the sheet and turn the feeding direction of the sheet. Additionally, the second curving section 21E includes a second guide portion 23B configured to contact the sheet and turn the feeding direction of the sheet. A region of the first guide portion 23A that is configured to contact the sheet has a cross-sectional shape bent in the form of a relaxation curve along a plane defined by the feeding direction and the thickness direction of the sheet on the first guide portion 23A. Further, a region of the second guide portion 23B that is configured to contact the sheet has a cross-sectional shape bent in the form of a relaxation curve along a plane defined by the feeding direction and the thickness direction of the sheet on the second guide portion 23B.

In the embodiment, a clothoid curve is employed as the relaxation curve. Specifically, a curve is employed that is defined by the following mathematical expression 1.

$$x(l) = \int_0^l \cos\frac{\theta^2}{2}d\theta,\ y(l) = \int_0^l \sin\frac{\theta^2}{2}d\theta, \qquad \text{Mathematical Expression 1}$$

where parameters "x" and "y" are normalized Cartesian coordinates, and each of "1" and "θ" is a non-dimensional length measured along the clothoid curve from the initial position thereof.

In the embodiment, the first curving section 21C, which includes the first guide portion 23A, does not have any rollers provided thereon to feed the sheet. Further, the second curving section 21E, which includes the second guide portion 23B, does not have any rollers provided thereon to feed the sheet.

Figure 2:
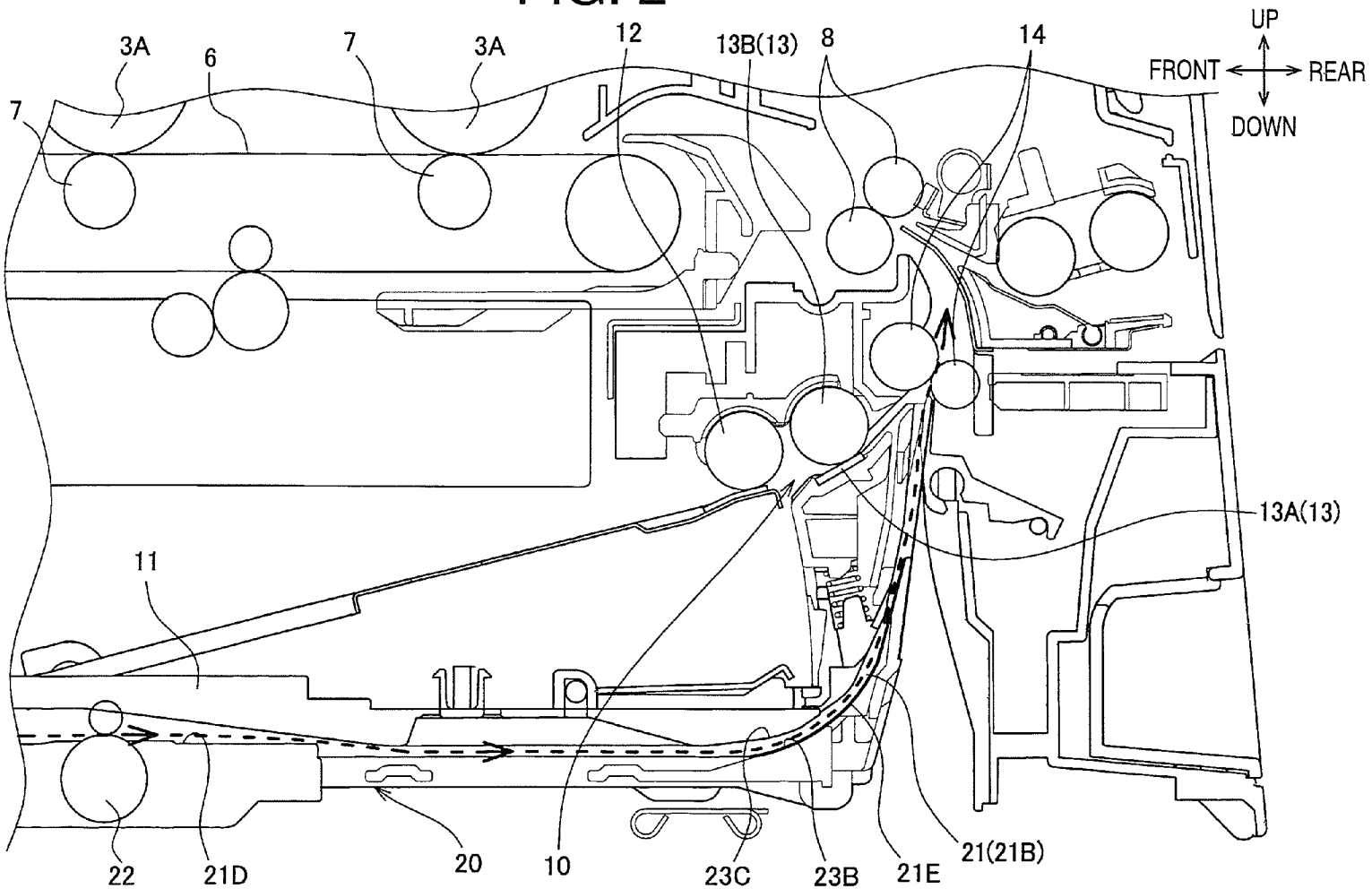
FIG. 2 is an enlarged cross-sectional side view showing a configuration around a second guide portion of the image forming apparatus in the embodiment according to one or more aspects of the disclosure.

Thus, for instance, as shown in FIG. 2, the second guide portion 23B is disposed between a re-feeding roller 22 and the feed rollers 14 adjacent to the re-feeing roller 22 on the feeding path.

The "rollers involved in sheet feeding" may include a driving roller for providing a feeding force to the sheet and an idle roller configured to be rotated by contact with the sheet being fed. Further, in the embodiment, a guide surface 23C, which faces the second guide portion 23B across the second re-feeding path 21B, has a cross-sectional shape bent in the form of a relaxation curve along a plane defined by the feeding direction and the thickness direction of the sheet on the second guide portion 23B.

3. Features of Sheet Feeding Unit and Image Forming Apparatus

In the embodiment, a sheet feeder according to aspects of the disclosure is applied to the re-feeding unit 20 for re-feeding the sheet. Further, in the embodiment, each of the first guide portion 23A and the second guide portion 23B for turning the feeding direction of the sheet is bent in the form of a relaxation curve.

Thereby, in the embodiment, it is possible to suppress the rise in a frictional force acting on the sheet that might be caused by a drastically increased acceleration applied to the sheet being fed. Hence, it is possible to prevent a sheet jam.

In the embodiment, each of the first guide portion 23A and the second guide portion 23B is configured to turn the feeding direction of the sheet having been fed on a linearly extending section of the feeding path (e.g., the linear section 21D). Hereinafter, linearly extending sections of the feeding path will be referred to "linear feeding sections."

In the embodiment, each of the first guide portion 23A and the second guide portion 23B is bent in the form of a relaxation curve. Therefore, it is possible to prevent the acceleration applied to the sheet from drastically rising around a boundary between the linear feeding section followed by the first curving section 21C and the first curving section 21C. It is possible to prevent the acceleration applied to the sheet from drastically rising around a boundary between the linear feeding section (the linear section 21D) followed by the second curving section 21E and the second curving section 21E. Accordingly, it is possible to suppress the rise in the frictional force acting on the sheet around the boundaries and thus prevent a sheet jam around the boundaries.

Figure 3:
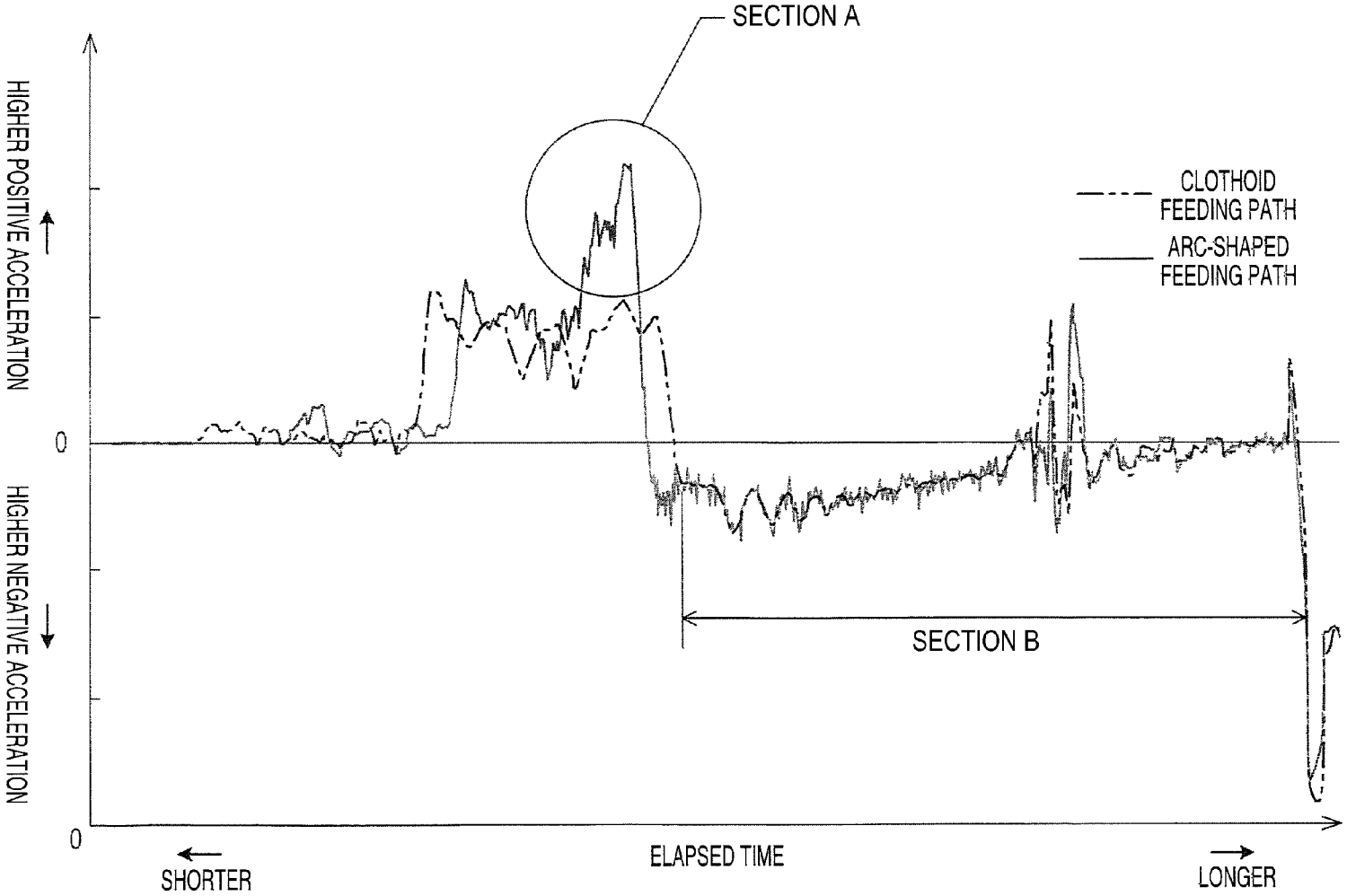
FIG. 3 is a graph showing a relationship between an elapsed time and an acceleration applied to a sheet around a second curving section of the image forming apparatus in the embodiment according to one or more aspects of the disclosure.

FIG. 3 is a graph showing a relationship between an elapsed time and the acceleration applied to the sheet around the second curving section 21E. In FIG. 3, a long dashed double-short dashed line indicates the change of the acceleration in the case where the second guide portion 23B is formed in a clothoid curve shape. A solid line indicates the change of the acceleration in the case where the second guide portion 23B is formed in an arc shape. In SECTION A of FIG. 3 a known arc-shaped feeding path includes a section where acceleration applied to the sheet is drastically changed and the sheet is hard pressed against the feeding path. Meanwhile, the clothoid feeding path includes a curving section where the acceleration applied to the sheet is nearly constant, but no partial section where the sheet is hard pressed against the section. In SECTION B after the sheet is nipped by the feed rollers, the sheet is fed in a stable posture and it results in a small change in the acceleration. It is noted that FIG. 3 shows results obtained from a numerical simulation analysis using a computer based on an assumption that the sheet size is A4 and the feeding velocity is 28 PPM.

As is clear from FIG. 3, on the second guide portion 23B of the embodiment, the acceleration is nearly constant, and an average acceleration and a maximum acceleration are lower than when the second guide portion 23B is formed in the arc shape. Further, a drastic rise in the acceleration is suppressed around the boundary between the linear section 21D and the second curving section 21E.

The higher the feeding velocity for feeding the sheet is, the greater the frictional force acting on the sheet is. Therefore, as exemplified in the embodiment, when the first guide portion 23A and the second guide portion 23B of the second re-feeding path 21B on which the sheet is fed at a high feeding velocity are bent in the form of a relaxation curve, it is possible to effectively suppress a drastic rise in the acceleration applied to the sheet around the boundaries.

A large feeding force is generally applied to the sheet being fed on the second curving section 21E for turning the feeding direction of the sheet upward. Therefore, as exemplified in the embodiment, when the second curving section 21E for turning the feeding direction of the sheet is provided with the second guide portion 23B bent in the form of a relaxation curve, it is possible to effectively suppress a drastic rise in the acceleration applied to the sheet around the boundary between the linear section 21D and the second curving section 21E.

As described above, in the embodiment, it is possible to suppress a drastic rise in the acceleration applied to the sheet. Accordingly, as exemplified in the embodiment, when the first curving section 21C and the second curving section 21E of the re-feeding path 21 that include the first guide portion 23A and the second guide portion 23B, respectively, do not have any rollers provided thereon to feed the sheet, it is possible to prevent a sheet jam and reduce a manufacturing cost of (the sheet feeding unit 10 of) the image forming apparatus 1.

Hereinabove, the embodiment according to aspects of the disclosure has been described. The disclosure can be practiced by employing conventional materials, methodology and equipment. Accordingly, the details of such materials, equipment and methodology are not set forth herein in detail. In the previous descriptions, numerous specific details are set forth, such as specific materials, structures, chemicals, processes, etc., in order to provide a thorough understanding of the disclosure. However, it should be recognized that the disclosure can be practiced without reapportioning to the details specifically set forth. In other instances, well known processing structures have not been described in detail, in order not to unnecessarily obscure the disclosure.

Only an exemplary embodiment of the disclosure and but a few examples of their versatility are shown and described in the disclosure. It is to be understood that the disclosure is capable of use in various other combinations and environments and is capable of changes or modifications within the scope of the inventive concept as expressed herein. For example, the following modifications are possible.

(Modifications)

In the aforementioned embodiment, the clothoid curve defined by the mathematical expression 1 is employed as a relaxation curve. Nevertheless, other relaxation curves may be employed such as a cubic curve, a transition curve diminishing sine half wave length, a lemniscate curve, a logarithmic spiral curve, and a McConnell curve.

In the aforementioned embodiment, the basic curve defined by the mathematical expression 1 is employed as a clothoid curve. Nevertheless, other curves may be employed such as a sigmoid curve (S-shaped curve), an oval (egg-shaped curve), and a compositely-shaped curve.

It is noted that preferably, the basic curve may be used for connecting linear sections. Preferably, a sigmoid curve (S-shaped curve) may be used for connecting curving sections that curve in respective different directions. Preferably, an oval (egg-shaped curve) may be used for connecting curving sections that curve in the same direction. Preferably, a compositely-shaped curve may be used for connecting sections each of which is formed with a plurality of clothoid curves being linked.

In the aforementioned embodiment, each of the first guide portion 23A and the second guide portion 23B is formed in the shape of the relaxation curve. Nevertheless, only one of the first guide portion 23A and the second guide portion 23B may be formed in the shape of the relaxation curve.

In the aforementioned embodiment, the first guide portion 23A and the second guide portion 23B, which are provided to the re-feeding unit 20, are formed in the shape of the relaxation curve. Nevertheless, a guide portion of a different curving section may be formed in the shape of a relaxation curve.

In the aforementioned embodiment, aspects of the disclosure are applied to the re-feeding unit 20 of the image forming apparatus 1. Nevertheless, for instance, aspects of the disclosure may be applied to a document feeder of an image reading apparatus.

In the aforementioned embodiment, the guide surface 23C, which faces the second guide portion 23B across the second re-feeding path 21B, has the cross-sectional shape bent in the form of the relaxation curve along the plane defined by the feeding direction and the thickness direction of the sheet on the second guide portion 23B. Nevertheless, the guide surface 23C may have a cross-sectional shape bent in an arc form.

What is claimed is:

1. A sheet feeder comprising:

a feeding unit configured to feed a sheet through a feeding path, the feeding path comprising an upstream feeding path configured to feed the sheet in a first feeding direction and a downstream feeding path configured to feed the sheet in a second feeding direction different from the first feeding direction; and a guide portion configured to turn a feeding direction of the sheet from the first feeding direction in which the sheet is fed through the upstream feeding path to the second feeding direction in which the sheet is fed through the downstream feeding path and bent in a shape of a clothoid curve defined by a following mathematical expression:

$$x(l) = \int_0^l \cos\frac{\theta^2}{2}d\theta,\ y(l) = \int_0^l \sin\frac{\theta^2}{2}d\theta,$$

where parameters "x" and "y" are normalized Cartesian coordinates, and each of "1" and "θ" is a non-dimensional length measured along the clothoid curve from an initial position thereof.

2. The sheet feeder according to claim 1, wherein the upstream feeding path comprises a linear section followed by the guide portion, and wherein the guide portion is configured to turn the feeding direction of the sheet that has been fed on the linear section.

3. The sheet feeder according to claim 1, wherein the feeding path comprises:

a first section configured to feed the sheet at a first feeding velocity; and a second section configured to feed the sheet at a second feeding velocity higher than the first feeding velocity, the second section comprising the guide portion.

4. The sheet feeder according to claim 1, wherein the downstream feeding path comprises an upward-turning section configured to turn the feeding direction of the sheet upward, and wherein the upward-turning section comprises the guide portion.

5. The sheet feeder according to claim 1, wherein the feeding path comprises a turning section configured to turn the feeding direction of the sheet, the turning section comprising the guide portion, the turning section having no rollers provided thereon to feed the sheet.

6. An image forming apparatus comprising:

an image forming unit configured to form an image on a sheet; and a sheet feeder comprising:

a feeding unit configured to feed a sheet through a feeding path, the feeding path comprising an upstream feeding path configured to feed the sheet in a first feeding direction and a downstream feeding path configured to feed the sheet in a second feeding direction different from the first feeding direction; and a guide portion configured to turn a feeding direction of the sheet from the first feeding direction in which the sheet is fed through the upstream feeding path to the second feeding direction in which the sheet is fed through the downstream feeding path and bent in a shape of a relaxation curve selected from the group consisting of a clothoid curve, a cubic curve, a transition curve diminishing sine half wave length, a lemniscate curve, a logarithmic spiral curve, and a McConnell curve.

7. The image forming apparatus according to claim 6, wherein the guide portion is bent in a shape of a clothoid curve.

8. The image forming apparatus according to claim 7, wherein the clothoid curve is defined by a following mathematical expression:

$$x(l) = \int_0^l \cos\frac{\theta^2}{2}d\theta,\ y(l) = \int_0^l \sin\frac{\theta^2}{2}d\theta,$$

where parameters "x" and "y" are normalized Cartesian coordinates, and each of "1" and "θ" is a non-dimensional length measured along the clothoid curve from an initial position thereof.

9. The image forming apparatus according to claim 6, wherein the upstream feeding path comprises a linear section followed by the guide portion, and wherein the guide portion is configured to turn the feeding direction of the sheet that has been fed on the linear section.

10. The image forming apparatus according to claim 6, wherein the feeding path comprises:

a first section configured to feed the sheet at a first feeding velocity; and a second section configured to feed the sheet at a second feeding velocity higher than the first feeding velocity, the second section comprising the guide portion.

11. The image forming apparatus according to claim 6, wherein the downstream feeding path comprises an upward-turning section configured to turn the feeding direction of the sheet upward, and wherein the upward-turning section comprises the guide portion.

12. The image forming apparatus according to claim 6, wherein the feeding path comprises a turning section configured to turn the feeding direction of the sheet, the turning section comprising the guide portion, the turning section having no rollers provided thereon to feed the sheet.

13. The image forming apparatus according to claim 6, wherein the sheet feeder is configured to re-feed, to the image forming unit, the sheet with the image formed thereon.

14. The image forming apparatus according to claim 6, further comprising a re-feeding path comprising the upstream feeding path and the downstream feeding path.

15. The image forming apparatus according to claim 14, wherein the upstream feeding path comprises a linear feeding path configured to feed a turned-around sheet from a rear side to a front side of the image forming apparatus.

16. The image forming apparatus according to claim 15, further comprising a feed tray configured to hold the sheet to be fed, wherein the upstream feeding path is disposed below the feed tray.

17. The image forming apparatus according to claim 16, further comprising a feed roller configured to feed the sheet fed from the feed tray, toward the image forming unit, wherein the downstream feeding path is configured to feed the sheet toward the feed roller.

* * * * *